US010501286B2

(12) United States Patent
Schmidt et al.

(10) Patent No.: US 10,501,286 B2
(45) Date of Patent: Dec. 10, 2019

(54) SIMULTANEOUS ELEVATOR CAR AND COUNTERWEIGHT SAFETY ACTUATION

(71) Applicant: OTIS ELEVATOR COMPANY, Farmington, CT (US)

(72) Inventors: Walter Thomas Schmidt, Marlborough, CT (US); Enrico Manes, Feeding Hills, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 243 days.

(21) Appl. No.: 15/593,457

(22) Filed: May 12, 2017

(65) Prior Publication Data

US 2018/0327223 A1 Nov. 15, 2018

(51) Int. Cl.

| | |
|---|---|
| ***B66B 5/18*** | (2006.01) |
| ***B66B 9/00*** | (2006.01) |
| ***B66B 5/04*** | (2006.01) |
| ***B66B 1/34*** | (2006.01) |

(52) U.S. Cl.

CPC ..... *B66B 5/18* (2013.01); *B66B 1/3461* (2013.01); *B66B 5/044* (2013.01); *B66B 9/00* (2013.01)

(58) Field of Classification Search

CPC ..... B66B 1/3461; B66B 5/044; B66B 5/16
See application file for complete search history.

(56) References Cited

U.S. PATENT DOCUMENTS

| | | | | |
|---|---|---|---|---|
| 1,242,394 | A | 10/1917 | Venn | |
| 2,490,653 | A | 12/1949 | Sahlin | |
| 5,782,319 | A | 7/1998 | Woodruff et al. | |
| 5,877,462 | A | 3/1999 | Chenais | |
| 6,318,506 | B1 * | 11/2001 | Marte | B66B 5/044 187/373 |
| 7,377,363 | B2 | 5/2008 | Flynn et al. | |
| 9,027,714 | B2 | 5/2015 | Husmann et al. | |

(Continued)

FOREIGN PATENT DOCUMENTS

| | | |
|---|---|---|
| CN | 102060223 | 5/2011 |
| CN | 105668365 | 6/2016 |

(Continued)

OTHER PUBLICATIONS

Machine Translation WO 2016/062686.*
Extended European Search Report for Application No. EP 18 17 1944 dated Oct. 10, 2018.

*Primary Examiner* — Diem M Tran
(74) *Attorney, Agent, or Firm* — Carlson, Gaskey & Olds

(57) ABSTRACT

An illustrative example embodiment of an elevator system includes an elevator car, a counterweight, roping coupling the elevator car and the counterweight, the roping supporting a load of the elevator car and the counterweight, and a plurality of safeties. The plurality of safeties includes a plurality of elevator car safeties supported for movement with the elevator car that are selectively actuated to engage a stationary surface to prevent movement of the elevator car. The plurality of safeties also includes a plurality of counterweight safeties supported for movement with the counterweight that are selectively actuated to engage a stationary surface to prevent movement of the counterweight. The safeties are configured for wireless communication causing essentially simultaneous actuation of the elevator car safeties and the counterweight safeties.

16 Claims, 3 Drawing Sheets

(56) References Cited

U.S. PATENT DOCUMENTS

| | | | | |
|---|---|---|---|---|
| 10,214,381 | B2 * | 2/2019 | Studer | B66B 1/32 |
| 2005/0279584 | A1 | 12/2005 | Reuter et al. | |
| 2007/0170010 | A1 | 7/2007 | Higashinaka | |
| 2008/0190710 | A1 * | 8/2008 | Shiratsuki | B66B 5/12 187/393 |
| 2008/0230325 | A1 * | 9/2008 | Chida | B66B 5/0031 187/393 |
| 2012/0152663 | A1 | 6/2012 | Legeret et al. | |
| 2013/0248296 | A1 | 9/2013 | Husmann | |
| 2015/0329318 | A1 * | 11/2015 | Cambruzzi | B66D 5/30 188/164 |
| 2017/0073190 | A1 * | 3/2017 | Dube | B66B 5/16 |

FOREIGN PATENT DOCUMENTS

| | | | |
|---|---|---|---|
| EP | 1604935 | A1 | 12/2005 |
| JP | 2000219450 | | 8/2000 |
| WO | 0055085 | | 9/2000 |
| WO | 2016/062686 | A1 | 4/2016 |

* cited by examiner

SIMULTANEOUS ELEVATOR CAR AND COUNTERWEIGHT SAFETY ACTUATION

BACKGROUND

Elevator systems are in widespread use. The machine for controlling movement of an elevator car may be hydraulic or traction-based. Elevator machines include machine brakes that effectively hold the elevator car stationary at a landing to allow passengers to enter or exit the car.

Elevator systems typically include safeties, which are braking devices that are used under conditions in which the elevator car is moving in an undesired manner. A governor device is typically roped to a safety on one side of the elevator car. If the elevator car moves at an undesirably high speed, for example, the governor activates the safety causing it to engage a guiderail to stop the elevator car. Some safety configurations include a linkage between safeties on opposite sides of the elevator car. When the governor activates one of the safeties the linkage operates to activate the other and the safeties engage a guiderail on both sides of the elevator car.

One issue presented during safety activation on a descending elevator car is that the inertia of the upwardly moving counterweight tends to cause the counterweight to continue moving even though the elevator car has stopped. Eventually the counterweight stops and may bounce because of slack in the roping that results from the continued movement of the counterweight after safety activation to stop the elevator car.

High rise elevators may include a tie down compensation mechanism near the bottom of the hoistway that tends to arrest counterweight jump. Tie down compensation mechanisms add cost and require additional space in an elevator system. It would be beneficial to be able to address the possibility of counterweight or elevator car jump without requiring a typical tie down mechanism.

SUMMARY

An illustrative example embodiment of an elevator system includes an elevator car, a counterweight, roping coupling the elevator car and the counterweight, the roping supporting a load of the elevator car and the counterweight, and a plurality of safeties. The plurality of safeties includes a plurality of elevator car safeties supported for movement with the elevator car that are selectively actuated to engage a stationary surface to prevent movement of the elevator car. The plurality of safeties also includes a plurality of counterweight safeties supported for movement with the counterweight that are selectively actuated to engage a stationary surface to prevent movement of the counterweight. The plurality of safeties are configured for wireless communication causing simultaneous actuation of the elevator car safeties and the counterweight safeties.

An example embodiment having one or more features of the elevator system of the previous paragraph includes a governor that instigates actuation of at least one of the safeties and the at least one of the safeties wirelessly communicates with others of the plurality of safeties providing an indication to actuate.

An example embodiment having one or more features of the elevator system of either of the previous paragraphs includes a governor that instigates actuation of the safeties by wirelessly communicating an indication to all of the plurality of safeties to actuate.

In an example embodiment having one or more features of the elevator system of any of the previous paragraphs, the governor broadcasts a wireless communication signal within a hoistway including the elevator car and the counterweight and the wireless communication signal includes the indication to actuate.

In an example embodiment having one or more features of the elevator system of any of the previous paragraphs, each of the safeties includes a brake member, an actuator that selectively controls movement of the brake member into a position to engage the stationary surface, and a transceiver that at least one of transmits and receives a wireless communication including an indication for safety actuation.

In an example embodiment having one or more features of the elevator system of any of the previous paragraphs, the transceiver receives the wireless communication including the indication for safety actuation; the transceiver determines whether the received wireless communication was transmitted by another one of the plurality of safeties or another device; and if the received wireless communication was not transmitted by another one of the plurality of safeties, the transceiver transmits a second wireless communication including the indication for safety actuation for reception by others of the plurality of safeties.

In an example embodiment having one or more features of the elevator system of any of the previous paragraphs, the wireless communication that causes simultaneous actuation of all of the safeties is a wireless communication between at least one of the safeties that is going to be actuated and at least one other of the safeties.

In an example embodiment having one or more features of the elevator system of any of the previous paragraphs, the essentially simultaneous actuation includes all of the safeties being actuated within less than 1 second of actuation of a first one of the safeties.

In an example embodiment having one or more features of the elevator system of any of the previous paragraphs, the essentially simultaneous actuation includes all of the safeties being actuated within less than one-half of 1 second of actuation of a first one of the safeties.

An illustrative example method is for controlling motion of an elevator car and a counterweight associated with the elevator car. The elevator car includes at least one elevator car safety that selectively prevents movement of the elevator car. The counterweight includes at least one counterweight safety that selectively prevents movement of the counterweight. The method includes determining that a condition exists that requires safety actuation of at least one of the elevator car safety or the counterweight safety; wirelessly communicating an indication to cause safety actuation to the safeties; and actuating the at least one elevator car safety and the at least one counterweight safety essentially simultaneously based on the wirelessly communicated indication.

In an example embodiment having one or more features of the method of the previous paragraph, actuating the safeties essentially simultaneously includes actuating all of the safeties within less than 1 second of actuation of a first one of the safeties.

In an example embodiment having one or more features of the method of any of the previous paragraphs, the essentially simultaneous actuation includes all of the safeties being actuated within less than one-half of 1 second of actuation of a first one of the safeties.

In an example embodiment having one or more features of the method of any of the previous paragraphs, wirelessly communicating the indication to cause safety actuation includes wirelessly communicating between at least one of the safeties and at least one other of the safeties.

In an example embodiment having one or more features of the method of any of the previous paragraphs, wirelessly communicating the indication to cause safety actuation includes broadcasting the indication from a governor for reception by all of the safeties.

In an example embodiment having one or more features of the method of any of the previous paragraphs, determining the condition includes detecting a speed of movement of the elevator car or the counterweight using a governor; and wirelessly communicating the indication includes wirelessly transmitting a signal from the governor to at least one of the safeties.

An example embodiment having one or more features of the method of any of the previous paragraphs includes receiving the wireless communication including the indication at one of the safeties; determining whether the received wireless communication was transmitted by another one of the safeties or another device; and if the received wireless communication was not transmitted by another one of the safeties, transmitting a second wireless communication including the indication for safety actuation from the one of the safeties for reception by at least one other of the safeties.

The various features and advantages of at least one disclosed example embodiment will become apparent to those skilled in the art from the following detailed description. The drawings that accompany the detailed description can be briefly described as follows.

DETAILED DESCRIPTION

Example embodiments of this invention provide essentially simultaneous actuation of safeties associated with an elevator car and a counterweight that reduces or eliminates counterweight or elevator car jump without relying on a tie down mechanism. By controlling the safeties and actuating the elevator car and counterweight safeties essentially simultaneously, elevator system costs and space requirements can be reduced because the tie down mechanism can be simplified or eliminated.

Figure 1:
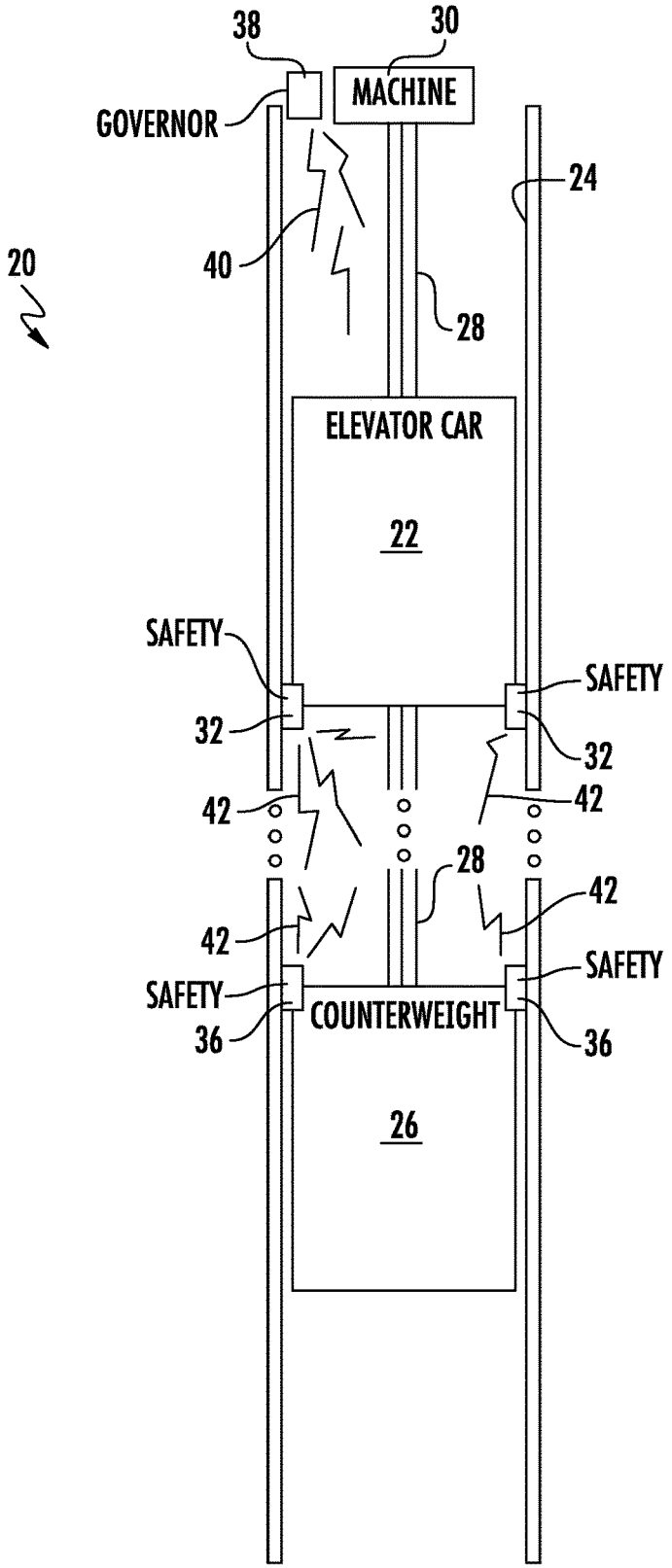
FIG. 1 schematically illustrates selected portions of an elevator system designed according to an embodiment of this invention.

FIG. 1 schematically illustrates selected portions of an elevator system 20. An elevator car 22 is situated within a hoistway 24. The elevator car 22 is coupled to a counterweight 26 by a roping arrangement 28 that comprises round ropes or flat belts, for example. A machine 30 controls movement and position of the elevator car by controlling movement of the roping arrangement 28.

Under most circumstances the machine 30 controls whether the elevator car 22 moves and determines a speed with which the elevator car moves. There may be situations, however, when the elevator car 22 moves in an undesired manner, such as moving at an undesirably high speed. There are known reasons why there may be such an over speed condition.

The elevator car 22 includes elevator car safeties 32 supported for movement with the elevator car through the hoistway 24. The elevator car safeties 32 are configured to engage a stationary surface in the hoistway 24, such as a guide rail (not illustrated), to prevent undesired movement of the elevator car 22. In the illustrated example, the counterweight 26 includes counterweight safeties 36 that are configured to prevent undesired movement of the counterweight, such as during an over speed condition.

A governor 38 operates in a known manner to detect undesired movement, such as moving too fast, of the elevator car 22 and the counterweight 26, respectively. In some embodiments, there is a dedicated governor device for each of the elevator car 22 and the counterweight 26 but only one governor 38 is schematically illustrated for discussion purposes.

In the illustrated elevator system 20, the governor 38 communicates wirelessly (as schematically shown at 40) with any of the safeties 32, 36 that should be actuated to prevent further undesired movement of the elevator car 22 or counterweight 26. In the illustrated embodiment the plurality of safeties 32, 36 are configured for wireless communication with each other (as schematically shown at 42) and with the governor 38.

One feature of the elevator system 20 is that all of the plurality of safeties, which includes the elevator car safeties 32 and the counterweight safeties 36, are actuated simultaneously or essentially simultaneously. Simultaneous actuation is used in this document to refer to actuation within very close proximity in time and does not necessarily require actuation of all of the plurality of safeties at exactly the same instant in time. For example, actuating all of plurality of safeties within one second of actuation of a first one of the safeties is sufficiently simultaneous to accomplish the result provided by the simultaneous actuation of embodiments of this invention. In some embodiments, the safeties are all actuated within less than one-half of one second of actuation of a first one of the safeties.

The simultaneous or essentially simultaneous actuation of all of the plurality of safeties prevents elevator car or counterweight jump that otherwise might occur if just the elevator car safeties 32 were actuated or only the counterweight safeties 36 were actuated. By controlling safety actuation according to an embodiment of this invention, the possibility of elevator car or counterweight jump is reduced or eliminated and there is less or no requirement for tie down compensation components near the bottom of the hoistway. The unique safety actuation technique of embodiments of this invention provides better control over elevator component movement, improved passenger experience and reduced elevator system cost.

Wireless communication facilitates or causes simultaneous actuation of the safeties 32, 26 in one of several ways, depending on the embodiment. In some examples, the governor 38 broadcasts a wireless signal including an indication to actuate throughout the hoistway 24 so that all of the plurality of safeties 32, 36 receive a command or indication to actuate directly from the governor 38. After receiving the broadcast communication, all of the plurality of safeties actuate essentially simultaneously.

In other examples, the governor 38 communicates with at least one of the elevator car safeties 32 when the elevator car 22 is moving in an undesirable manner requiring safety actuation to stop the car. In such examples, the safety (or safeties) 32 that receives the command or indication from the governor recognizes that the communication is from the governor and transmits a command or indication to the other safeties. In some embodiments, each safety 32, 36 serves as a communication relay within the hoistway 24 to ensure that all safeties 32, 36 receive the indication to actuate to facilitate simultaneous safety actuation.

Figure 2:
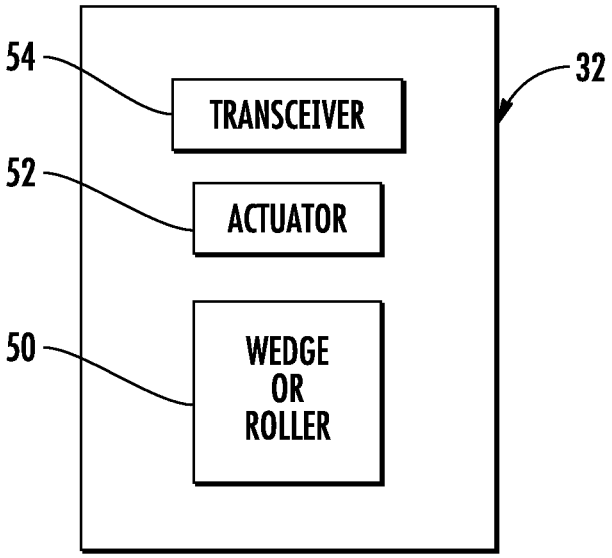
FIG. 2 diagrammatically illustrates selected features of an example safety braking device designed according to an embodiment of this invention.

FIG. 2 schematically illustrates an example embodiment of one of the elevator car safeties 32. The counterweight safeties 36 have the same features in at least some embodiments. The example safety 32 includes a brake member 50, such as a wedge or roller, that is configured to engage a guiderail surface to apply a braking force to prevent movement of the elevator car 22. An actuator 52 controls a position of the brake member 50 to avoid safety actuation until it is needed. In some examples, the actuator 52 is controlled electronically to selectively release the brake member from a disengaged position in response to a command or indication to actuate the safety 32. A transceiver 54 receives wireless communications or signals including an indication to actuate the safety. The transceiver 54 in this example also has the capability to transmit wireless communications or signals to the governor 38 or others of the plurality of safeties 32, 36.

In an example embodiment the transceiver 54 includes sufficient processing capacity to determine the source of a received wireless communication. For example, the transceiver 54 determines when a received communication including an indication to actuate the safety 32 came from the governor 38. If so, the transceiver 54 transmits a corresponding signal for reception by the other safeties 32, 36 including an indication to actuate. If, on the other hand, the transceiver 54 determines that the received communication originated from another one of the safeties 32, 36, then the transceiver does not need to repeat or relay the indication to actuate. In either event, the indication to actuate in the communication received by the transceiver 54 is processed in a manner that causes the actuator 52 to actuate the safety 32.

Figure 3:
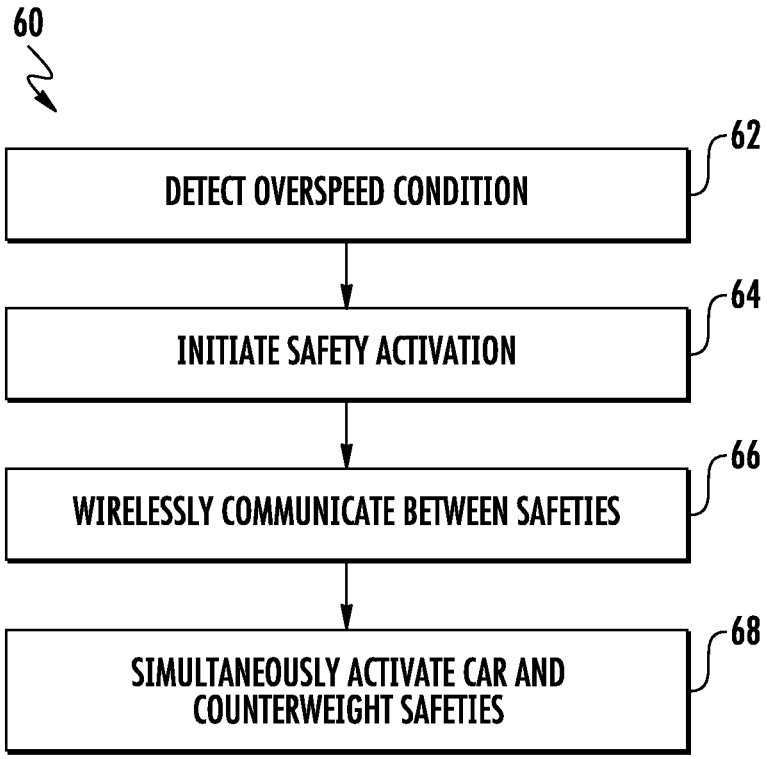
FIG. 3 is a flow chart diagram summarizing an example safety actuation technique designed according to an embodiment of this invention.

FIG. 3 is flowchart diagram 60 that summarizes a safety actuation method according to an embodiment of this invention. The governor detects an overspeed condition, for example, at 62. Safety actuation is initiated at 64 by the governor 38 in this example by transmitting a wireless signal to at least one of the safeties 32, 36. The safeties 32, 36 communicate with each other at 66 so that all of the plurality of safeties 32, 36 has received an indication or command to actuate. At 68 the plurality of safeties 32, 36 actuate simultaneously. As a result, the elevator car 22 and counterweight 26 stop essentially simultaneously.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

an elevator car;

a counterweight;

roping coupling the elevator car and the counterweight, the roping supporting a load of the elevator car and the counterweight; and a plurality of safeties, wherein:

the plurality of safeties includes a plurality of elevator car safeties supported for movement with the elevator car, the elevator car safeties being selectively actuated to engage a stationary surface to prevent movement of the elevator car, the plurality of safeties includes a plurality of counterweight safeties supported for movement with the counterweight, the counterweight safeties being selectively actuated to engage a stationary surface to prevent movement of the counterweight, and the plurality of safeties are configured for wireless communication causing essentially simultaneous actuation of the elevator car safeties and the counterweight safeties.

2. The elevator system of claim 1, comprising a governor that instigates actuation of at least one of the safeties, and wherein the at least one of the safeties wirelessly communicates with others of the plurality of safeties providing an indication to actuate.

3. The elevator system of claim 1, comprising a governor that instigates actuation of the safeties by wirelessly communicating an indication to all of the plurality of safeties to actuate.

4. The elevator system of claim 3, wherein the governor broadcasts a wireless communication signal within a hoistway including the elevator car and the counterweight, and the wireless communication signal includes the indication to actuate.

5. The elevator system of claim 1, wherein each of the safeties includes a brake member, an actuator that selectively controls movement of the brake member into a position to engage the stationary surface, and a transceiver that at least one of transmits and receives a wireless communication including an indication for safety actuation.

6. The elevator system of claim 5, wherein the transceiver receives the wireless communication including the indication for safety actuation;

the transceiver determines whether the received wireless communication was transmitted by another one of the plurality of safeties or another device; and if the received wireless communication was not transmitted by another one of the plurality of safeties, the transceiver transmits a second wireless communication including the indication for safety actuation for reception by others of the plurality of safeties.

7. The elevator system of claim 1, wherein the wireless communication that causes simultaneous actuation of all of the safeties is a wireless communication between at least one of the safeties that is going to be actuated and at least one other of the safeties.

8. The elevator system of claim 1, wherein the essentially simultaneous actuation includes all of the safeties being actuated within less than 1 second of actuation of a first one of the safeties.

9. The elevator system of claim 8, wherein the essentially simultaneous actuation includes all of the safeties being actuated within less than one-half of 1 second of actuation of a first one of the safeties.

10. A method of controlling motion of an elevator car and a counterweight associated with the elevator car, the elevator car including at least one elevator car safety that selectively prevents movement of the elevator car, the counterweight including at least one counterweight safety that selectively prevents movement of the counterweight, the method comprising:

determining that a condition exists that requires safety actuation of at least one of the elevator car safety or the counterweight safety;

wirelessly communicating an indication to cause safety actuation to the safeties; and actuating the at least one elevator car safety and the at least one counterweight safety essentially simultaneously based on the wirelessly communicated indication.

11. The method of claim 10, wherein actuating the safeties essentially simultaneously includes actuating all of the safeties within less than 1 second of actuation of a first one of the safeties.

12. The method of claim 11, wherein the essentially simultaneous actuation includes all of the safeties being actuated within less than one-half of 1 second of actuation of a first one of the safeties.

13. The method of claim 10, wherein wirelessly communicating the indication to cause safety actuation includes wirelessly communicating between at least one of the safeties and at least one other of the safeties.

14. The method of claim 10, wherein wirelessly communicating the indication to cause safety actuation includes broadcasting the indication from a governor for reception by all of the safeties.

15. The method of claim 10, wherein determining the condition includes detecting a speed of movement of the elevator car or the counterweight using a governor; and wirelessly communicating the indication includes wirelessly transmitting a signal from the governor to at least one of the safeties.

16. The method of claim 10, comprising receiving the wireless communication including the indication at one of the safeties;

determining whether the received wireless communication was transmitted by another one of the safeties or another device; and if the received wireless communication was not transmitted by another one of the safeties, transmitting a second wireless communication including the indication for safety actuation from the one of the safeties for reception by at least one other of the safeties.

* * * * *